US009486906B2

(12) United States Patent
Zhao et al.

(10) Patent No.: US 9,486,906 B2
(45) Date of Patent: Nov. 8, 2016

(54) LOCKOUT FOR FASTENER-DRIVING TOOL

(75) Inventors: Hanxin Zhao, Northbrook, IL (US); Christopher H. Porth, Gurnee, IL (US); Stephen P. Moore, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 933 days.

(21) Appl. No.: 13/469,795

(22) Filed: May 11, 2012

(65) Prior Publication Data

US 2013/0299546 A1 Nov. 14, 2013

(51) Int. Cl.

| | |
|---|---|
| ***B25C 1/14*** | (2006.01) |
| ***B25C 1/18*** | (2006.01) |
| ***B25C 1/08*** | (2006.01) |
| *B25C 1/00* | (2006.01) |

(52) U.S. Cl.

CPC *B25C 1/08* (2013.01); *B25C 1/008* (2013.01)

(58) Field of Classification Search

CPC ..... B25C 1/04; B25C 1/08; B25C 1/14; B25C 1/18; B25C 1/008; F01L 9/026; F01L 2009/0432; F01L 2009/0434

USPC ..... 227/8–10, 130, 131

See application file for complete search history.

(56) References Cited

U.S. PATENT DOCUMENTS

| | | | | |
|---|---|---|---|---|
| 32,452 | A | 5/1861 | Phelps | |
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 5,133,329 | A | 7/1992 | Rodseth et al. | |
| 5,197,646 | A | 3/1993 | Nikolich | |
| 5,213,247 | A | 5/1993 | Gschwend et al. | |
| 5,263,439 | A | 11/1993 | Doherty et al. | |
| 5,713,313 | A | 2/1998 | Berry | |
| 5,762,035 | A * | 6/1998 | Schebitz | 123/90.11 |

(Continued)

FOREIGN PATENT DOCUMENTS

| | | |
|---|---|---|
| DE | 19853555 | 5/2000 |
| EP | 1459850 | 9/2004 |

(Continued)

OTHER PUBLICATIONS

International Search Report and Written Opinion for International Application No. PCT/US2013/039821, mailed Feb. 28, 2014 (9 pages).

(Continued)

*Primary Examiner* — Andrew M Tecco

(74) *Attorney, Agent, or Firm* — Neal, Gerber & Eisenberg LLP

(57) ABSTRACT

A combustion-powered fastener-driving tool includes a combustion-powered power source having a combustion chamber, a reciprocating piston and driver blade, and a valve sleeve reciprocable relative to the power source between a rest position and a firing position. The valve sleeve partially defines the combustion chamber. A lockout device is in fluid communication with the combustion power source and includes a reciprocating gas piston connected to a latch in operational proximity to the valve sleeve. The lockout device is configured such that upon combustion in the combustion chamber, gas from the combustion engages the gas piston and moves the latch to an engaged position in which the valve sleeve is prevented from moving to the rest position.

11 Claims, 6 Drawing Sheets

(56) References Cited

U.S. PATENT DOCUMENTS

| | | | | |
|---|---|---|---|---|
| 5,909,836 | A | 6/1999 | Shkolnikov et al. | |
| 6,123,241 | A | 9/2000 | Walter et al. | |
| 6,145,724 | A | 11/2000 | Shkolnikov et al. | |
| 6,425,354 | B1 | 7/2002 | Buchel et al. | |
| 6,460,507 | B2 | 10/2002 | Thieleke et al. | |
| 6,526,926 | B1 | 3/2003 | Towfighi | |
| 6,532,917 | B2 | 3/2003 | Thieleke et al. | |
| 6,619,246 | B2 * | 9/2003 | Hall | 123/90.11 |
| 6,666,366 | B2 | 12/2003 | Rosenbaum et al. | |
| 6,695,195 | B2 | 2/2004 | Nishikawa et al. | |
| 6,783,045 | B2 | 8/2004 | Shima et al. | |
| 6,826,935 | B2 | 12/2004 | Gokcebay et al. | |
| 6,889,885 | B2 | 5/2005 | Ohmori | |
| 6,971,568 | B2 | 12/2005 | Schiestl et al. | |
| 7,021,251 | B2 | 4/2006 | Ohmori et al. | |
| 7,284,511 | B2 | 10/2007 | Zahner | |
| 7,383,974 | B2 * | 6/2008 | Moeller et al. | 227/8 |
| 7,573,779 | B2 * | 8/2009 | Kanasugi et al. | 365/239 |
| 7,673,779 | B2 * | 3/2010 | Moeller et al. | 227/10 |
| 7,703,648 | B2 * | 4/2010 | Tamura et al. | 227/8 |
| 8,205,582 | B2 | 6/2012 | Adams | |
| 2005/0091962 | A1 * | 5/2005 | Van Erden et al. | 60/39.6 |
| 2005/0173484 | A1 | 8/2005 | Moeller et al. | |
| 2005/0247749 | A1 | 11/2005 | Wywialowski et al. | |
| 2006/0102111 | A1 | 5/2006 | Ohmori et al. | |
| 2007/0034659 | A1 | 2/2007 | Moeller | |
| 2008/0237295 | A1 * | 10/2008 | Adams | 227/130 |

FOREIGN PATENT DOCUMENTS

| | | |
|---|---|---|
| JP | 2002/144253 | 5/2002 |
| WO | WO 02/16085 | 2/2002 |
| WO | WO 2008/118838 | 10/2008 |

OTHER PUBLICATIONS

International Preliminary Report on Patentability for International Application No. PCT/US2013/039821, dated Nov. 11, 2014 (6 pages).

* cited by examiner

LOCKOUT FOR FASTENER-DRIVING TOOL

BACKGROUND

The present invention relates generally to fastener-driving tools used to drive fasteners into workpieces, and specifically to pneumatic or combustion-powered fastener-driving tools, also referred to as fastener drivers.

Combustion-powered tools are known in the art. Exemplary tools are manufactured by Illinois Tool Works, Inc. of Glenview, Ill. for use in driving fasteners into workpieces, and are described in commonly assigned patents to Nikolich U.S. Pat. Re. No. 32,452, and U.S. Pat. Nos. 4,522,162; 4,483,473; 4,483,474; 4,403,722; 5,133,329; 5,197,646; 5,263,439; 6,145,724 and 7,383,974 all of which are incorporated by reference herein.

Such tools incorporate an external tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: cooling the engine, mixing the fuel and air within the chamber, and removing, or scavenging, combustion by-products. The engine includes a reciprocating piston with an elongated, rigid driver blade disposed within a single cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber. This same movement of the tool against the workpiece causes the fan inside the combustion chamber to turn on and mix the fuel with the air inside the combustion chamber.

Upon the pulling of a trigger, which closes a trigger switch, a spark is generated for igniting a charge of gas in the combustion chamber of the engine, the resulting high pressure inside the chamber causes the combined piston and driver blade to be forced downward to impact a positioned fastener and drive it into the workpiece. Just before the piston impacts a resilient bumper at a lower end of the cylinder, the piston passes an exhaust port, through which some of the exhaust gas is vented. Next, the tool valve sleeve and cylinder absorb heat from the combustion to generate vacuum pressure that pulls the piston back to its uppermost position for the next cycle. Fasteners are fed magazine-style into the nosepiece, where they are held in a properly positioned orientation for receiving the impact of the driver blade.

For efficient operation, it is preferred that the combustion chamber remains sealed until the piston returns to its uppermost or pre-firing position. The amount of time that the combustion chamber remains closed is a function of the operator's work rhythm and is often too short when attempting a repetitive cycle operation, where the trigger remains pulled and the workpiece contact element (WCE) is rapidly pressed upon the workpiece for fastener driving, and then the tool is quickly lifted and moved to the next fastener location.

With combustion-powered tools of the type disclosed in the patents incorporated by reference above, by firing rate and control of the valve sleeve, the operator controls the time interval provided for the vacuum-type piston return.

The formation of the vacuum occurs following the combustion of the mixture and the exhausting of the high-pressure burnt gases. With residual high temperature gases in the tool, the surrounding lower temperature aluminum components cool and collapse the gases, thereby creating a vacuum. In many cases, such as in trim applications, the operator's cycle rate is slow enough that vacuum return works consistently and reliably.

However, for those cases where a tool is operated at a much higher cycle rate, the operator can open the combustion chamber during the piston return cycle by removing the tool from the workpiece. This causes the vacuum to be lost and piston travel will stop before reaching the top of the cylinder. This leaves the driver blade in the guide channel of the nosepiece, thereby preventing the nail strip from advancing towards the nose. The net result is no nail in the firing channel and no nail fired in the next shot.

To assure adequate closed combustion chamber dwell time in the sequentially-operated combustion tools identified above, a chamber lockout device is known that is linked to the trigger. This mechanism holds the combustion chamber closed until the operator releases the trigger. This extends the dwell time (during which the combustion chamber is closed) by taking into account the operator's relatively slow musculature response time. In other words, the physical release of the trigger consumes enough time of the firing cycle to assure piston return. The mechanism also maintains a closed chamber in the event of a large recoil event created, for example, by firing into hard wood or on top of another nail. It is disadvantageous to maintain the chamber closed longer than the minimum time to return the piston, as cooling and purging of the tool is prevented.

In commonly-assigned U.S. Pat. No. 7,383,974, an electromagnetic solenoid controls a pivoting latch for periodically locking the valve sleeve in the closed position. In some cases, electromagnetic force has been found to lack sufficient holding power for retaining the valve sleeve against motion along the main tool axis towards the open position of the valve sleeve.

Thus, there is a need for a combustion-powered fastener-driving tool which is capable of operating in a repetitive cycle mode. There is also a need for a combustion-powered fastener-driving tool which addresses the special needs of delaying the opening of the combustion chamber to achieve complete piston return in a repetitive cycle mode.

SUMMARY

The above-listed needs are met or exceeded by the present fastener-driving tool which overcomes the limitations of the current technology. Among other things, the present tool incorporates a combustion chamber lockout that is designed to temporarily lock the valve sleeve in the closed position and maintain the combustion chamber sealed until the piston can be returned to its pre-firing position. An advantage of the present lockout mechanism is that it is operative independent of the particular operator work rhythm.

A feature of the present lockout mechanism is a relatively small gas cylinder enclosing a reciprocating gas piston that is in direct fluid communication with the combustion chamber. A piston rod of the gas piston is connected at a free end to a pivoting latch. A pivot axis of the latch preferably extends transversely to a main tool axis, defined by the direction of motion of the main tool piston and driver blade. The latch reciprocates between a disengaged position, with the gas piston rod in an extended position relative to the gas cylinder, and an engaged position, with the gas piston rod retracted relative to the gas cylinder. The gas piston preferably reciprocates transversely to the main tool axis. A return spring in the gas cylinder biases the gas piston toward the extended position. In the engaged position, the latch engages a portion of the valve sleeve such that it cannot move from the closed position to the open position until the latch is disengaged.

During a fastener driving cycle, once combustion occurs in the combustion chamber, high gas pressure from the combustion chamber is diverted to the gas cylinder, overcomes the force of the return spring and pushes the piston within the cylinder so that the latch moves from the disengaged position to the engaged position, where a locking end of the latch engages the tool valve sleeve and prevents the sleeve from moving in a way that opens the combustion chamber. Once the latch is in the engaged position, an electromagnet associated with the gas cylinder is energized and holds the gas piston in the retracted position so that the valve sleeve is prevented from opening once the combustion-generated gas pressure decreases.

A tool control system controls the energization of the electromagnet. Once the main piston returns to its pre-firing position, an event determined in a variety of ways, including the expiration of a preset period of time, the electromagnet is deenergized, releasing the hold on the gas piston, so that the return spring pushes the gas piston to the point where the gas piston rod is in the extended position, and the latch is disengaged. Upon disengagement of the latch, the valve sleeve is free to move to the open position, venting the spend combustion gases and allowing the input of a fresh supply of air for the next combustion.

More specifically, the present combustion-powered fastener-driving tool includes a combustion-powered power source having a combustion chamber, a reciprocating piston and driver blade, and a valve sleeve reciprocable relative to the power source between a rest position and a firing position. The valve sleeve partially defines the combustion chamber. A lockout device is in fluid communication with the combustion power source and includes a reciprocating gas piston connected to a latch in operational proximity to the valve sleeve. The lockout device is configured such that upon combustion in the combustion chamber, gas from the combustion engages the gas piston and moves the latch to an engaged position in which the valve sleeve is prevented from moving to the rest position.

In another embodiment, a lockout mechanism is provided for use with a fastener-driving tool having a reciprocating valve sleeve and a main piston reciprocating between a pre-firing position and a fastener-driving position. The mechanism includes a gas cylinder enclosing a gas piston having a piston rod extending from the cylinder and reciprocating within the cylinder between a first position and a second position. A return spring biases the gas piston in the first position. An electromagnet is associated with the gas cylinder such that upon energization of the electromagnet, the gas piston is retained in the second position. A gas conduit is connected between the gas cylinder and a combustion power source for periodically receiving a supply of compressed gas for operating the gas piston in a way that overcomes a force of the return spring. A latch has a first portion connected to the gas piston and a second portion configured for engaging the valve sleeve, and pivots between a disengaged position, in which the valve sleeve freely moves between a rest position and a firing position, and an engaged position, in which the valve sleeve is prevented from moving from the firing position to the rest position.

In still another embodiment, a fastener-driving tool is provided, including a combustion-powered power source having a combustion chamber, and a piston and driver blade reciprocating along a main tool axis between a pre-firing position and a fastener driving position. A valve sleeve reciprocates along the main tool axis relative to the power source between a rest position and a firing position and partially defines the combustion chamber. A lockout device is in fluid communication with the power source and includes a reciprocating gas piston moving between an extended position and a retracted position. A latch in the lockout device is in operational proximity to the valve sleeve and moves between a disengaged position, in which the valve sleeve moves between the firing position and the rest position, and an engaged position in which the valve sleeve is prevented from moving from the firing position to the rest position. A tool control system is connected to an electromagnet associated with the gas cylinder and is configured for energizing the electromagnet for a preset period of time. The tool is configured such that upon combustion in the combustion chamber, gas from the combustion engages the gas piston and moves the latch to the engaged position in which the valve sleeve is prevented from moving to the rest position, and the control system energizes the electromagnet for retaining the gas piston in the retracted position until the main piston returns to the pre-firing position.

DETAILED DESCRIPTION

Figure 1:
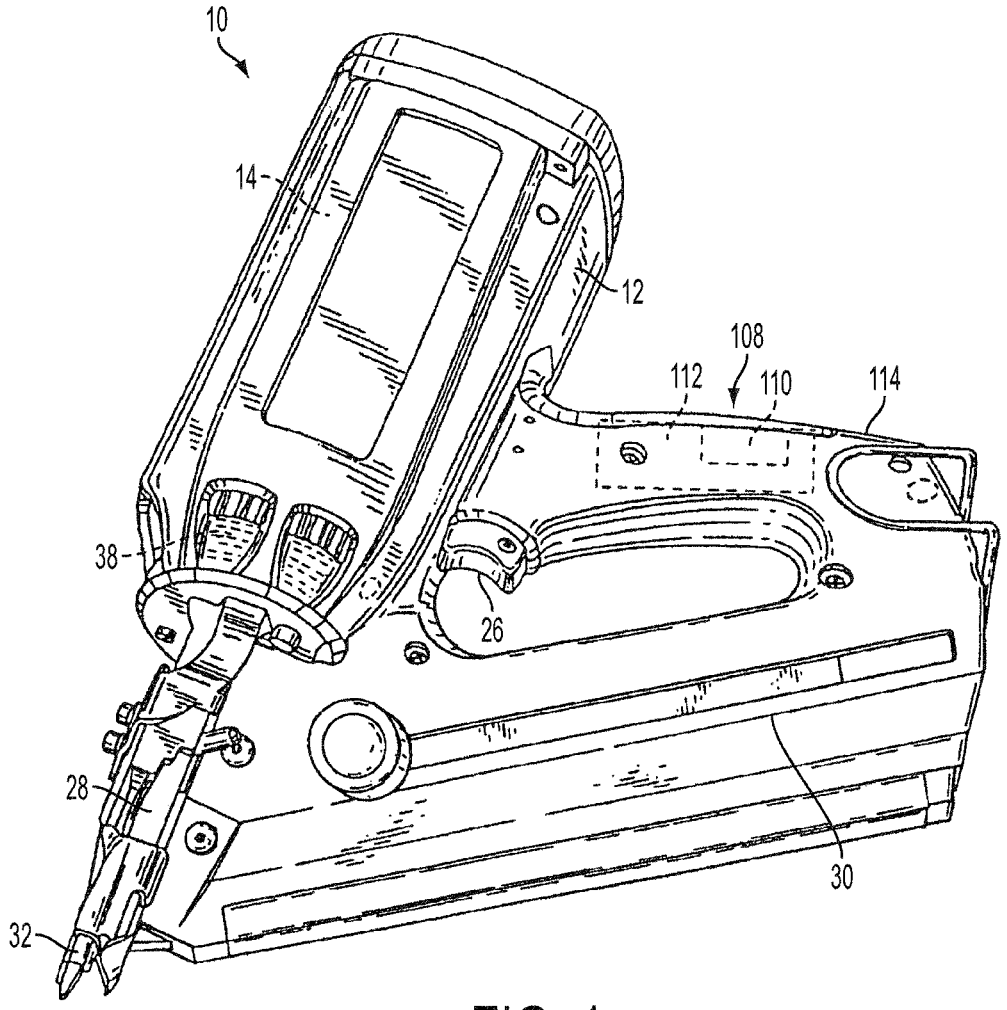
FIG. 1 PRIOR ART
FIG. 1 is a front perspective view of a prior art fastener-driving tool.
Figure 2:
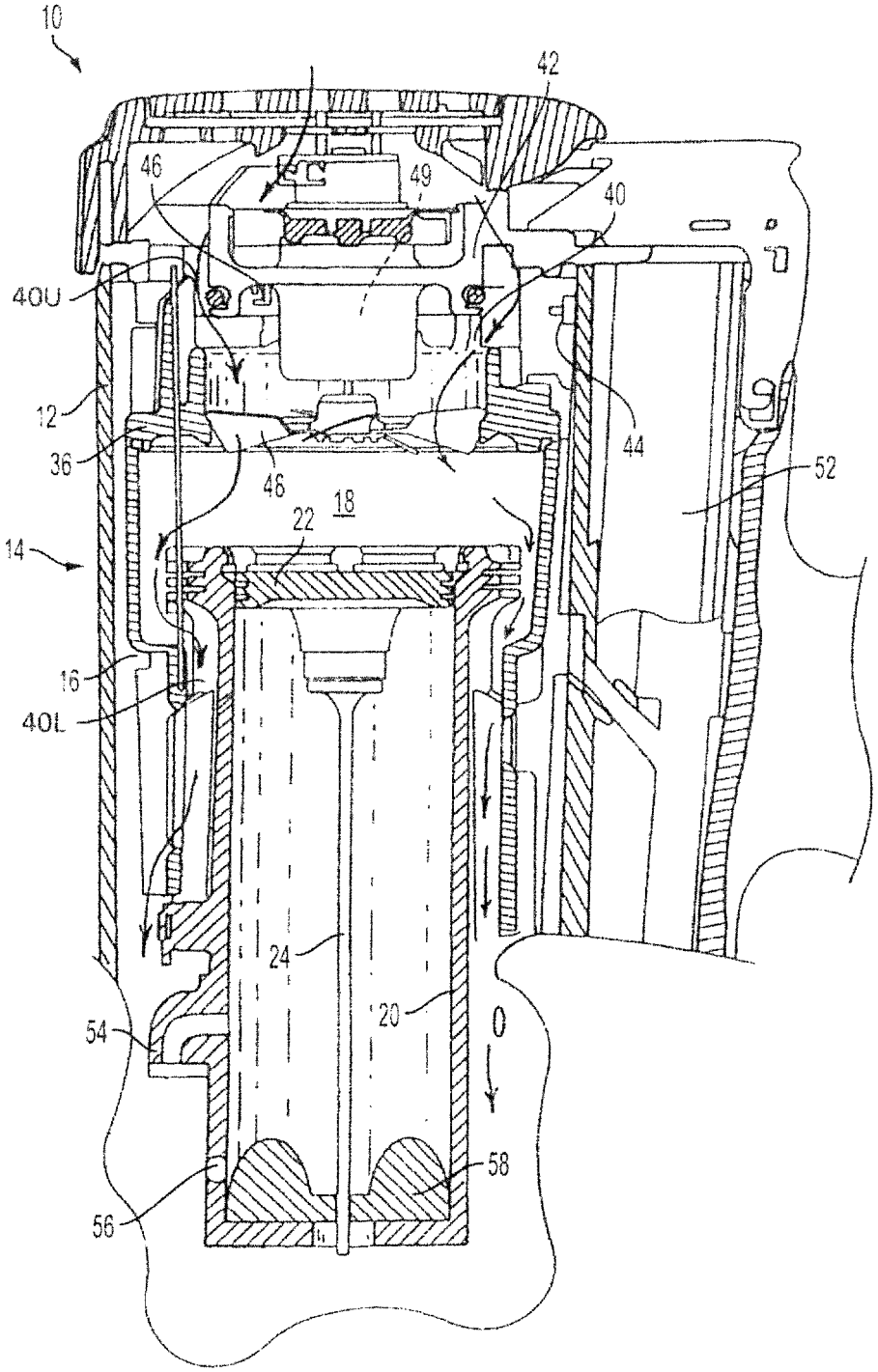
FIG. 2 PRIOR ART
FIG. 2 is a fragmentary vertical cross-section of the tool of FIG. 1 shown in the rest position.

Referring now to FIGS. 1 and 2, a prior art combustion-powered fastener-driving tool incorporating the present invention is generally designated 10 and preferably is of the general type described in detail in the patents listed above and incorporated by reference in the present application. As will be seen below, this tool 10 is modified as described to incorporate the features of the present lockout system. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22, also referred to as a main piston, reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

Through depression of a trigger 26, an operator induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage or upper probe 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element 32 to move from a rest position to a firing position. This movement overcomes the normally downward biased orientation of the workpiece contact element 32 caused by a spring 38 (shown hidden in FIG. 1). It is contemplated that the location of the spring 38 may vary to suit the application, and locations displaced farther from the nosepiece 28 are envisioned.

Through the linkage 34, the workpiece contact element 32 is connected to and reciprocally moves with, the valve sleeve 36. In the rest position (FIG. 2), the combustion chamber 18 is not sealed, since there is an annular gap 40 separating the valve sleeve 36 and a cylinder head 42, which accommodates a chamber switch 44 and a spark plug 46. Specifically, there is an upper gap 40U near the cylinder head 42, and a lower gap 40L near the upper end of the cylinder 20. In the preferred embodiment of the prior art tool 10, the cylinder head 42 also is the mounting point for a cooling fan 48 and a fan motor 49 powering the cooling fan. The fan 48 and at least a portion of the motor 49 extend into the combustion chamber 18 as is known in the art and described in the patents which have been incorporated by reference above. In the rest position depicted in FIG. 2, the tool 10 is disabled from firing because the combustion chamber 18 is not sealed at the top with the cylinder head 42, and the chamber switch 44 is open.

Figure 3:
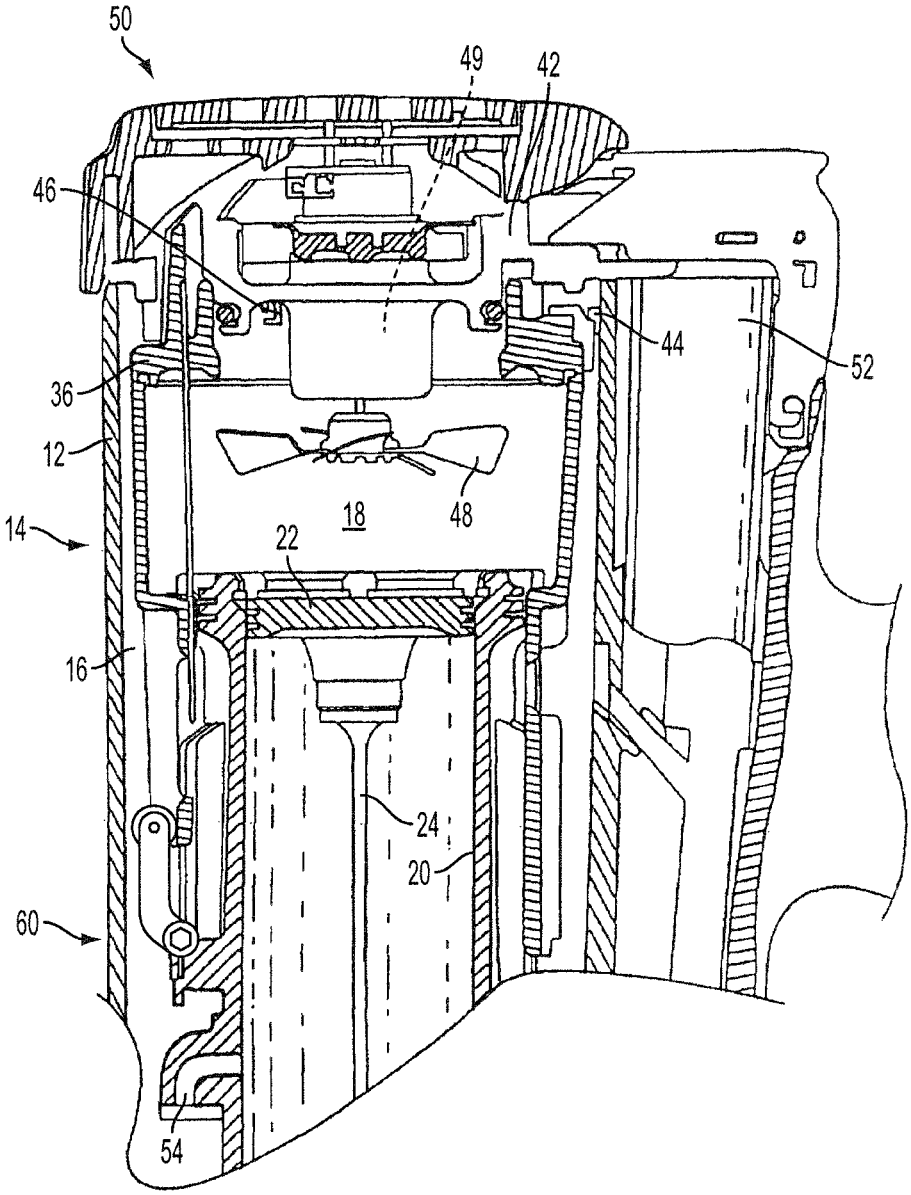
FIG. 3 is a fragmentary vertical cross-section of the present tool, similar to the tool of FIG. 2 but shown in the pre-firing position.
Figure 4:
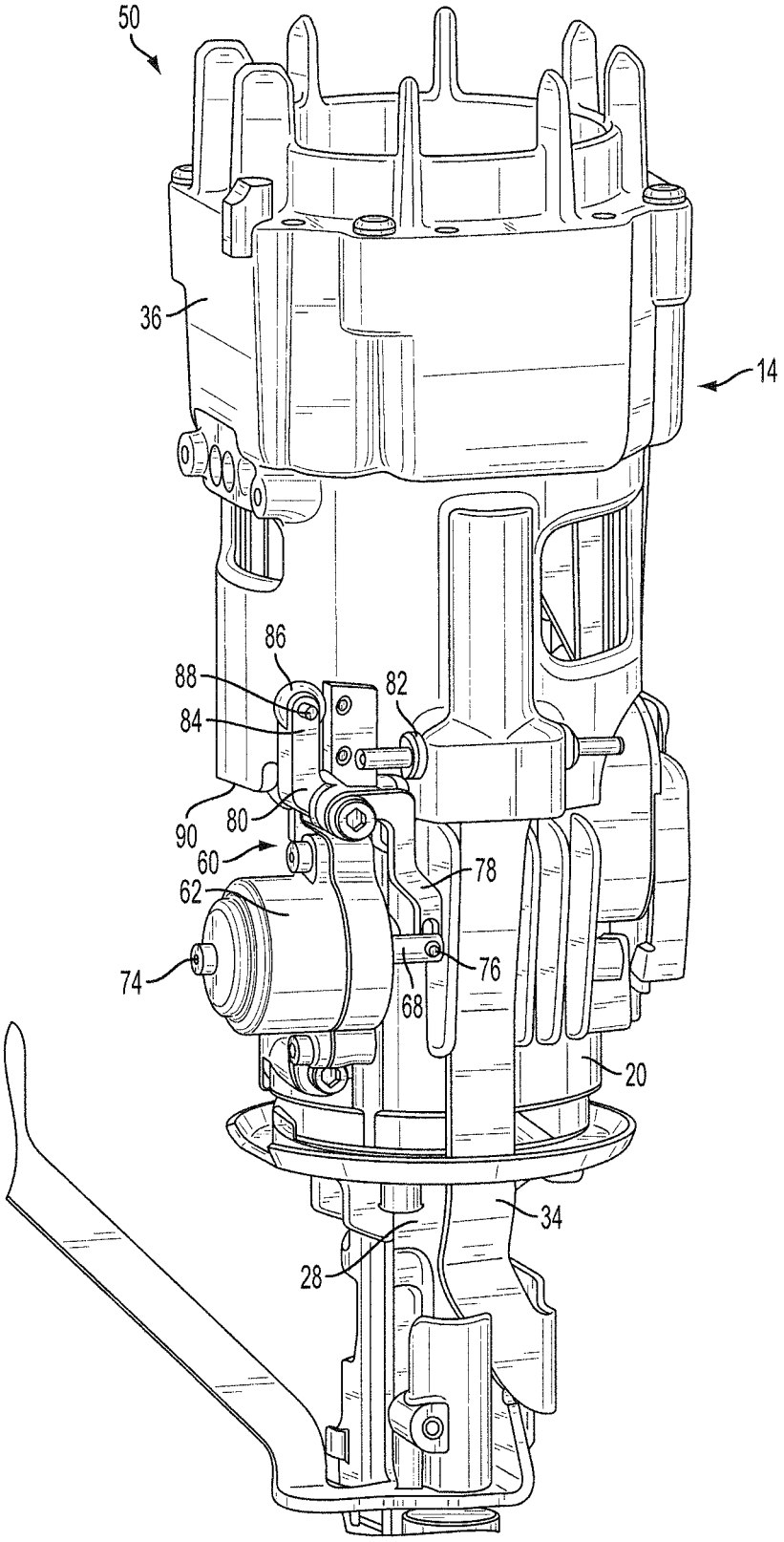
FIG. 4 is a fragmentary side elevation of the present fastener-driving tool with the lockout in the disengaged position.
Figure 5:
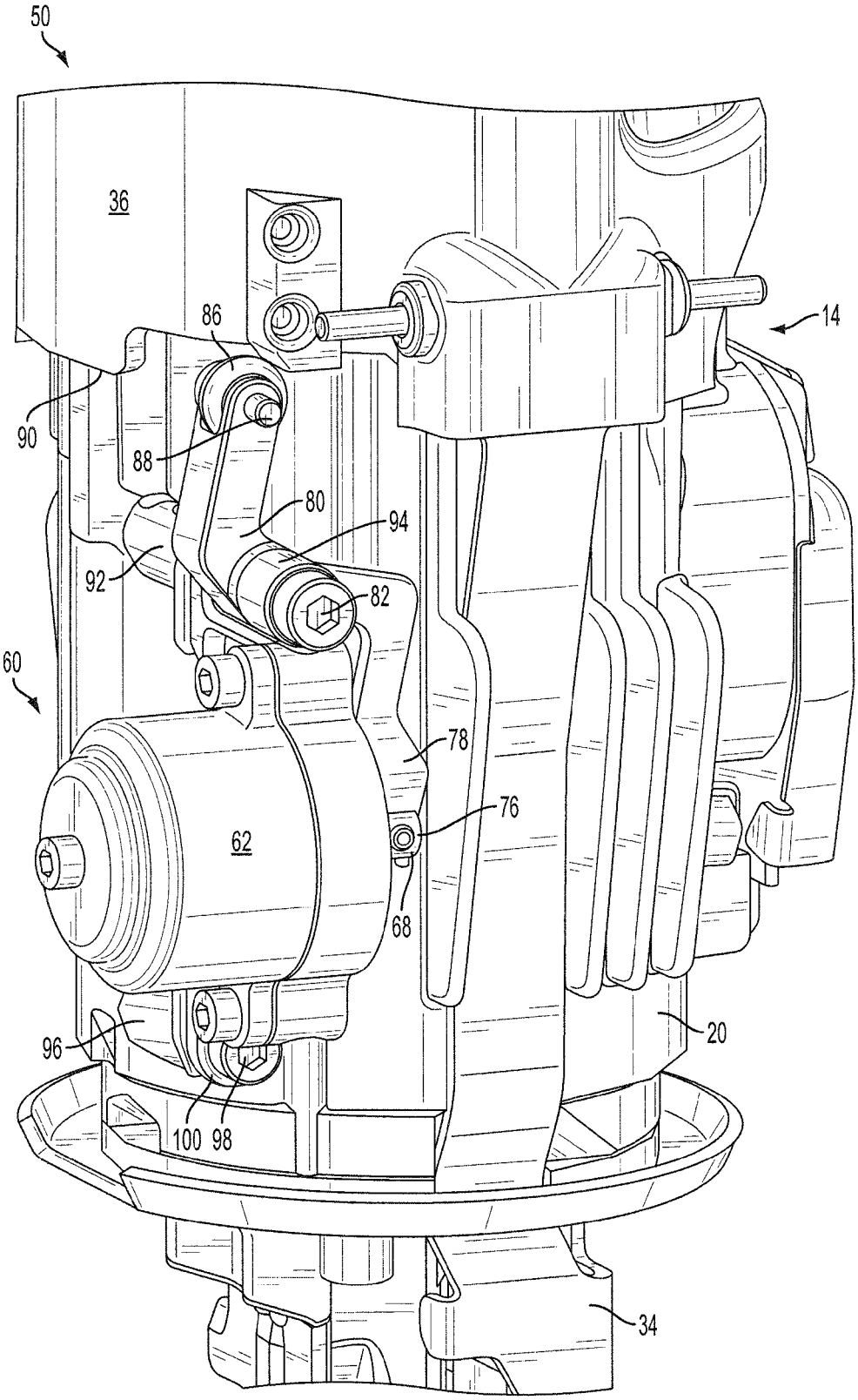
FIG. 5 is a fragmentary side elevation of the tool of FIG. 4 with the lockout latch in the engaged position, holding the valve sleeve in the closed position.
Figure 6:
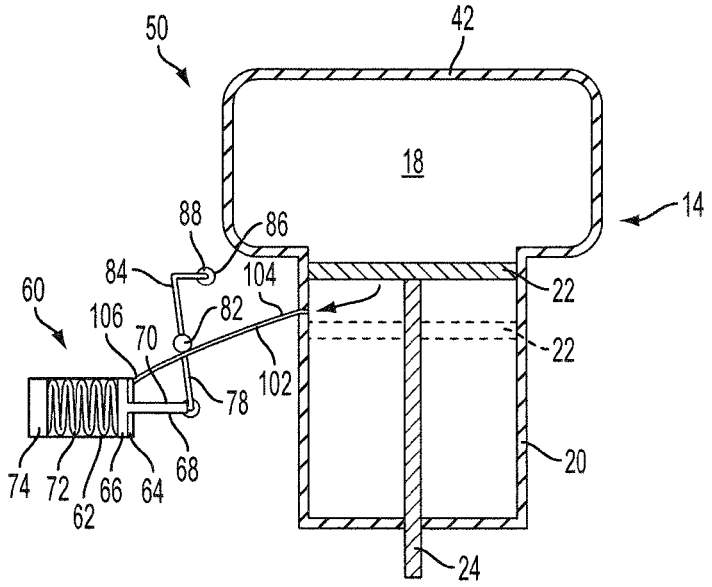
FIG. 6 is a schematic vertical section of the present tool depicting the internal operation of the gas piston and the latch in the disengaged position.

Referring now to FIGS. 3-5, the combustion tool of the invention is generally designated 50. Components shared with the tool 10 are designated with identical reference numbers. Firing is enabled when an operator presses the workpiece contact element 32 against a workpiece. This action overcomes the biasing force of the spring 38, causes the valve sleeve 36 to move upward relative to the housing 12, closing the gaps 40U and 40L and sealing the combustion chamber 18 until the chamber switch 44 is activated. This operation also induces a measured amount of fuel to be released into the combustion chamber 18 from a fuel canister 52 (shown in fragment).

Upon a pulling of the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder 20, it pushes a rush of air which is exhausted through at least one petal or check valve 54 and at least one vent hole 56 located beyond piston displacement (FIG. 2). At the bottom of the piston stroke or the maximum piston travel distance, the piston 22 impacts a resilient bumper 58 (FIG. 2) as is known in the art. With the piston 22 beyond the exhaust check valve 54, high pressure gasses vent from the cylinder 20 until near atmospheric pressure conditions are obtained and the check valve 54 closes. Due to internal pressure differentials in the cylinder 20, the piston 22 is returned to the pre-firing position shown in FIG. 2.

As described above, one of the issues confronting designers of combustion-powered tools of this type is the need for a rapid return of the piston 22 to pre-firing position and improved control of the chamber 18 prior to the next cycle. This need is especially critical if the tool is to be fired in a repetitive cycle mode, where an ignition occurs each time the workpiece contact element 32 is retracted, and during which time the trigger 26 is continually held in the pulled or squeezed position.

Referring again to FIGS. 3-7, to accommodate these design concerns, the present tool 50 preferably incorporates a lockout device, generally designated 60 and configured for preventing the reciprocation of the valve sleeve 36 from the closed or firing position until the piston 22 returns to the pre-firing position. This holding, delaying or locking function of the lockout device 60 is operational for a specified period of time required for the piston 22 to return to the pre-firing position. Thus, the operator using the tool 50 in a repetitive cycle mode can lift the tool from the workpiece where a fastener was just driven, and begin to reposition the tool for the next firing cycle without risk of prematurely opening the combustion chamber 18.

Due to the shorter firing cycle times inherent with repetitive cycle operation, the lockout device 60 ensures that the combustion chamber 18 will remain sealed, and the differential gas pressures maintained so that the piston 22 will be returned before a premature opening of the chamber 18, which would normally interrupt piston return. With the present lockout device 60, the piston 22 return and subsequent opening of the combustion chamber 18 can occur while the tool 10 is being moved toward the next workpiece location.

Referring now to FIGS. 4-7, included in the lockout device 60 is a generally cylindrical housing 62 defining an internal cylinder 64 in which reciprocates a gas piston 66 having a gas piston rod 68. FIG. The piston rod 68 projects through an opening 70 in the housing 62. Opposite the piston rod 68, the gas piston 66 is biased towards the opening 70 by a gas return spring 72 located within the cylinder 64. Reciprocation of the gas piston 66 within the internal or gas cylinder 64 is between a first or extended position (FIG. 6) and a second or retracted position (FIG. 7), the gas return spring 72 biasing the gas piston to the extended position.

Figure 7:
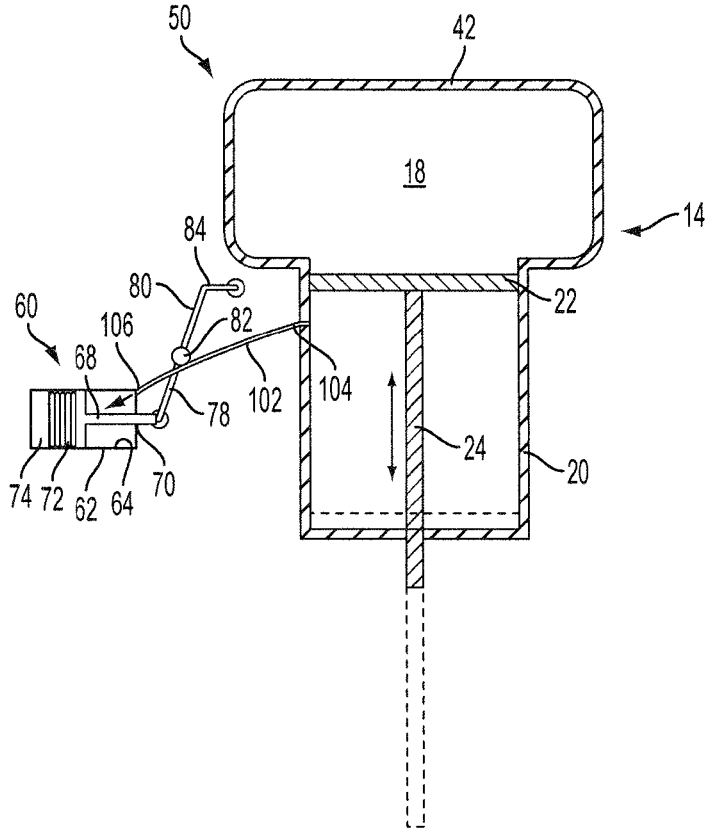
FIG. 7 is a schematic vertical section of the tool of FIG. 6 depicting the gas piston and the latch in the engaged position.

An electromagnet 74 is located within the housing 62 and is associated with the gas cylinder 64, preferably at an opposite end from the opening 70 and the piston rod 68. More specifically, the electromagnet 74 is constructed and arranged for retaining the gas piston 66 in the retracted position. As seen in FIG. 7, the gas return spring 72 is located in the gas cylinder 64 between the gas piston 66 and the electromagnet 74, and is compressed when the gas piston 66 is in the retracted position. As described below in greater detail, upon energization, the electromagnet 74 is sufficiently powerful for retaining the gas piston 66 in the retracted position for a specified period of time.

Referring now to FIGS. 4 and 5, which depict an exterior of the casting forming the cylinder 20 and the reciprocating valve sleeve 36, a free end 76 of the piston rod 68 is connected to a first portion 78 of a generally "S" or dogleg-shaped latch 80 that is configured for pivoting about a pivot axis 82 extending transverse to a main tool axis defined by movement of said driver blade 24. Opposite the first portion 78, the latch 80 has a second portion 84 configured for engaging the valve sleeve 36. While the specific configuration of the second portion 84 may vary to suit the situation, in the preferred embodiment, a small roller 86 is rotatably disposed at a tip 88 of the second portion 84. The second portion 84 is constructed and arranged for engaging the valve sleeve at a ledge 90 located just below the portion partially defining the combustion chamber 18 (FIG. 5).

In the preferred embodiment, the pivot axis 82 takes the form of a threaded fastener engaging a boss 92 (FIG. 5) in the cylinder 20. A suitable bearing 94 facilitates the pivoting action of the latch 80 about the axis 82 as is known in the art. Also, the cylindrical housing 62 is similarly attached to the cylinder 20 at a second boss 96, which receives a fastener 98 engaging an eyelet 100 attached to the housing.

Referring again to FIGS. 6 and 7, another feature of the present lockout device 60 is that the lockout device is in fluid communication with the combustion power source 14 such that a conduit or gas passageway 102 delivers combustion gas generated during combustion in the combustion chamber 18 during the fastener driving cycle. More specifically, the conduit 102 is constructed and arranged to siphon off a portion of the combustion gas after the piston 22 has passed the conduit 102 on the way to drive a fastener. Thus, one end 104 of the conduit 102 is connected to the cylinder 20, and the opposite end 106 is connected to the internal cylinder 64. The siphoned portion of combustion gas traveling through the conduit 102 forces the gas piston 66 to the retracted position and overcomes the force of the gas return spring 72. The electromagnet 74 retains the gas piston 66 in the retracted position under the control of a tool control system 108, preferably a control program 110 located in a Central Processing Unit (CPU) 112, usually located in the tool handle 114 (see FIG. 1), however other locations are contemplated. As is known in the art of combustion tools, the control system 108 controls energization of the spark plug 46, the operation of the fan motor 49 as well as other functions. In the present tool 50, the control system 108 also controls the energization of the electromagnet 74.

The main purpose of the electromagnet 74 holding the gas piston 66 in the retracted position is that the latch 80 is held in the engaged position (FIGS. 5 and 7)*which* engages the valve sleeve 36 and prevents it from moving from the closed position of FIG. 3 to the rest position of FIG. 2. Thus, the combustion chamber 18 remains closed as long as the latch 80 is in the engaged position. This condition is maintained as long as the electromagnet 74 is energized by the control system 108. While the specific time period of energization of the electromagnet 74 varies with the application, in the preferred embodiment, the electromagnet is energized by the control system 108 for approximately 100 msec. This period is considered sufficient such that enough dwell is provided to satisfy all operating conditions for full piston return. During this period, the latch 80 is held in the engaged position, thereby preventing the chamber 18 from opening.

Furthermore, the retention of the gas piston 66 in the retracted position (FIG. 7) prevents action of the gas return spring 72, which will force the gas piston 66 to the extended position (FIG. 6) upon de-energization of the electromagnet 74. This de-energization will permit release of the valve sleeve 36 from the latch 80, and the corresponding venting and recharge of the combustion chamber 18 for the next combustion.

A feature of the present tool 50 is that the control system 108 is configured such that the electromagnet 74 is energized for a time period sufficient for the main piston 22, shown in a fastener driving position in phantom in FIG. 7, to return to the pre-firing position (FIG. 2). It is also contemplated that the lockout device 60 and the latch 80 are potentially configured so that a reverse sequence of movement of the gas piston 66 (extended v. retracted) triggers the engagement/disengagement of the valve sleeve 36. Another feature of the present tool 50 is that the combination of pressurized combustion gas used for retracting the gas cylinder 66, coupled with electromagnetic power of the electromagnet 74 is more effective and consistent in the operation of retaining the valve sleeve 36 in the closed position, than relying solely on electromechanical power, as was done in prior tool lockout devices.

The control program 108 is configured so that once the piston 22 has returned to the pre-firing position; the electromagnet 74 is deenergized, reducing the transversely directed force on the latch 80. As the user lifts the tool 10 from the workpiece, and following timed de-energization of the electromagnet 74, the spring 38 will overcome the force of the gas return spring 72, and will cause the valve sleeve 36 to move to the rest or extended position, opening up the combustion chamber 18 and the gaps 40U, 40L. As is known, the valve sleeve 36 must be moved downwardly away from the fan 48 to open the chamber 18 for exchanging gases in the combustion chamber 18 and for preparing for the next combustion.

While a particular embodiment of the present lockout for a fastener-driving tool has been described herein, it will be appreciated by those skilled in the art that changes and modifications may be made thereto without departing from the invention in its broader aspects and as set forth in the following claims.

The invention claimed is:

1. A fastener-driving tool, comprising:

a combustion-powered power source having a housing, a combustion chamber, and a reciprocating piston and driver blade that each move along a main axis;

a valve sleeve reciprocable relative to said power source between a rest position and a firing position and partially defining said combustion chamber; and a lockout device in fluid communication with said power source and including a reciprocating gas piston connected to a latch in operational proximity to said valve sleeve, said latch being pivotably connected to said housing and configured such that upon combustion in said combustion chamber, gas from said combustion engages said gas piston and moves said latch to an engaged position in which said valve sleeve is prevented from moving to said rest position.

2. The tool of claim 1 further including a tool control system, and an electromagnet connected to said control system and located in operational proximity to said gas piston for holding said gas piston so that said latch is retained in said engaged position for a period determined by said control system.

3. The tool of claim 1 wherein said gas piston has a piston rod and reciprocates within a gas cylinder between an extended position and a retracted position, said cylinder being provided with a return spring for biasing said gas piston to said extended position.

4. The tool of claim 3 further including an electromagnet associated with said gas cylinder and constructed and arranged for retaining said gas piston in said retracted position under control of a tool control system.

5. The tool of claim 4 wherein said return spring is compressed when said gas piston is in said retracted position.

6. The tool of claim 3 wherein said return spring is located in said gas cylinder between said gas piston and said electromagnet.

7. The tool of claim 3 wherein said electromagnet is located at an end of said gas cylinder opposite said gas piston rod.

8. The tool of claim 1 wherein said latch pivots about a pivot axis extending transverse to said main axis and includes a first portion connected to said gas piston, and a second portion configured for engaging said valve sleeve.

9. The tool of claim 8 wherein said first portion of said latch is pivotally connected to a rod of said gas piston.

10. The tool of claim 1, wherein said reciprocating piston moves between a pre-firing position and a driving position, and a tool control system configured for causing said latch to remain in said engaged position after a combustion until said reciprocating piston reaches the pre-firing position.

11. A fastener-driving tool, comprising:

a combustion-powered power source having a combustion chamber, and a main piston and driver blade reciprocating along a main tool axis between a pre-firing position and a fastener driving position;

a valve sleeve reciprocating along said main tool axis relative to said power source between a rest position and a firing position and partially defining said combustion chamber; and a lockout device in fluid communication with said combustion power source and including a reciprocating gas piston moving between an extended position and a retracted position, and a latch pivotably connected to said gas piston and in operational proximity to said valve sleeve and moving between a disengaged position in which said valve sleeve moves between said firing position and said rest position, and an engaged position in which said valve sleeve is prevented from moving from said firing position to said rest position;

a tool control system connected to an electromagnet associated with said gas cylinder and configured for energizing said electromagnet for a preset period of time; and said tool configured such that upon combustion in said combustion chamber, gas from said combustion forces said gas piston to said retracted position, moving said latch to said engaged position in which said valve sleeve is prevented from moving to said rest position, and said control system energizes said electromagnet for retaining said gas piston in said retracted position until said main piston returns to said pre-firing position.

* * * * *